US007270057B2

(12) United States Patent
Motard

(10) Patent No.: US 7,270,057 B2
(45) Date of Patent: Sep. 18, 2007

(54) ROLLING ELEMENT ADJUSTMENT SYSTEM

(75) Inventor: Marcel Motard, Laval (CA)

(73) Assignee: RDP Marathon Inc., Laval (CA)

( * ) Notice: Subject to any disclaimer, the term of this patent is extended or adjusted under 35 U.S.C. 154(b) by 0 days.

(21) Appl. No.: 10/765,082

(22) Filed: Jan. 28, 2004

(65) Prior Publication Data

US 2005/0160930 A1 Jul. 28, 2005

(51) Int. Cl.
*B41F 13/24* (2006.01)
*B41F 7/02* (2006.01)

(52) U.S. Cl. ..... 101/247; 101/217; 101/218; 101/350.3

(58) Field of Classification Search ..... 101/247, 101/217, 218, 350.3
See application file for complete search history.

(56) References Cited

U.S. PATENT DOCUMENTS

| | | | | | |
|---|---|---|---|---|---|
| 1,934,776 | A | | 11/1933 | Stonssel | |
| 3,072,050 | A | | 1/1963 | Wolff | |
| 3,108,536 | A | | 10/1963 | Harrison | |
| 3,147,702 | A | | 9/1964 | Martin | |
| 3,259,060 | A | * | 7/1966 | Martin | 101/144 |
| 3,616,751 | A | | 11/1971 | Mowry | |
| 3,785,287 | A | * | 1/1974 | Dahlgren | 101/247 |
| 4,000,692 | A | * | 1/1977 | Wirz et al. | 101/144 |
| 4,130,057 | A | * | 12/1978 | List et al. | 101/148 |
| 4,423,681 | A | | 1/1984 | Smith | |
| 4,462,311 | A | | 7/1984 | Arrnalln | |
| 4,524,712 | A | * | 6/1985 | Ito | 118/46 |
| 4,569,306 | A | * | 2/1986 | Ito et al. | 118/249 |
| 4,711,173 | A | * | 12/1987 | Emrich et al. | 101/350.3 |
| RE33,522 | E | | 1/1991 | Hermach et al. | |
| 5,197,385 | A | | 3/1993 | Burger | |
| 5,282,417 | A | | 2/1994 | Germann | |
| 5,351,616 | A | * | 10/1994 | Gelinas et al. | 101/218 |
| 5,375,522 | A | * | 12/1994 | Junghans | 101/424 |
| 5,473,983 | A | * | 12/1995 | Maul | 101/217 |
| 5,630,363 | A | | 5/1997 | Davis et al. | |
| 5,697,297 | A | | 12/1997 | Rasmussen | |
| 5,758,577 | A | * | 6/1998 | Ebina | 101/423 |
| 5,787,808 | A | | 8/1998 | Stram et al. | |

(Continued)

FOREIGN PATENT DOCUMENTS

| | | |
|---|---|---|
| EP | 0325445 | 7/1989 |

(Continued)

*Primary Examiner*—Andrew H. Hirshfeld
*Assistant Examiner*—Marvin P. Crenshaw
(74) *Attorney, Agent, or Firm*—Ogilvy Renault LLP

(57) ABSTRACT

In a printing press, an adjustment system for positioning a rolling element such as a form roller or an impression cylinder relative to a first cylinder having a first diameter and relative to at least a second cylinder adapted to replace the first cylinder and having a second diameter different than the first diameter, the system comprising an actuating member operable to displace the rolling element relative to the first cylinder and having a pivotable fixed first end and a second end mechanically linked to the rolling element, the actuating member providing sufficient displacement to bring the rolling element into contact with the first cylinder such that a predetermined contact pressure therebetween is reached, the actuating member also being operable to bring the rolling element into contact with the second cylinder such that the predetermined contact pressure therebetween is reached. A method for displacing a rolling element is also presented.

15 Claims, 2 Drawing Sheets

U.S. PATENT DOCUMENTS

| | | | | |
|---|---|---|---|---|
| 5,806,427 | A * | 9/1998 | Niemiro et al. | 101/247 |
| 5,904,093 | A | 5/1999 | Pollock | |
| 6,327,975 | B1 * | 12/2001 | Izawa | 101/170 |
| 6,467,408 | B1 | 10/2002 | Hillebrand | |
| 6,539,857 | B1 | 4/2003 | Weschenfelder | |
| 2002/0105520 | A1 | 8/2002 | Kolbe et al. | |
| 2003/0029338 | A1 | 2/2003 | Hosterman | |

FOREIGN PATENT DOCUMENTS

| | | |
|---|---|---|
| EP | 1101611 | 5/2001 |
| EP | 1473158 | 11/2004 |

* cited by examiner

ROLLING ELEMENT ADJUSTMENT SYSTEM

TECHNICAL FIELD

The present invention relates generally to printing presses, and more particularly to a rolling element adjustment system for an offset printing press.

BACKGROUND OF THE INVENTION

Offset printing presses are well known in the art. Typically, water and ink are supplied to a printing plate cylinder, and are then transferred to a blanket cylinder for printing onto sheets or web, fed between the blanket cylinder and an impression cylinder. The water supply to the plate cylinder usually comprises a dampening unit having a dampening form roller which contacts the plate cylinder and is fed water from a water pan through intermediate water transferring rollers. Similarly, an inking unit transfers ink through one or more ink form rollers contacting the plate cylinder, the ink form rollers receiving ink from an ink supply through a series of ink transfer rollers.

While such presses have fixed lateral dimensions, and as such printed products wider than the length of the cylinders cannot be produced, the circumference of the rotating cylinders determines the length of each repeated pattern being printed onto the web or sheets passing therethrough. Accordingly, the larger the circumference of the plate and blanket cylinders being used, the longer the printed pattern that can be produced. Therefore, in order to permit a press to be modified to permit printing of different lengths of printed patterns, standard variable size presses provide a changeable insert comprising plate, blanket and impression cylinders. Replacement inserts comprising cylinders of different diameters can therefore be used with the same press.

An important parameter determining printing quality is the line of contact between two cylindrical rollers in contacting engagement, otherwise known as the contact stripe. Standard adjustment mechanisms between rollers and cylinders include mechanical means such as bolts or screws and single pneumatic actuators, to allow fine tuning of the contact stripe between, for example, the inking or dampening form roller and the plate cylinder. However, conventional adjustment mechanisms are usually adapted to be used with plate and blanket cylinders of fixed diameter.

On standard variable size presses, mechanical stoppers are usually included in the insert in order to adapt the adjustment mechanisms of the form rollers and cylinders to the plate and blanket cylinder diameter. Such stoppers offer only an adjustment having a limited precision.

Sleeve offset presses, such as the one disclosed in U.S. Application No. 60/457,295 by the applicant and incorporated herein by reference, provide for replacing only the plate and blanket cylinders, thereby eliminating the need for the various inserts. While the elimination of the inserts minimizes the complexity of changing cylinder sizes and reduces the storage space previously required for replacement inserts, it also eliminates the support for the prior mechanical stoppers. Integrating the stoppers directly on the cylinder bodies greatly increases their weight and cost. Alternatively, providing a different adjustment mechanism for each cylinder size can be very costly as well as increase the storage space necessary for spare parts and the down time when the cylinders are changed.

Accordingly, there is a need for a unique adjustment mechanism providing an adequate contact stripe adjustment between rolling elements in a printing press and being able to accommodate various dimensions of plate and blanket cylinders.

SUMMARY OF THE INVENTION

It is an object of the present invention to provide an improved adjustment system for rolling elements in an offset printing press.

Therefore, in accordance with the present invention, there is provided in a printing press an adjustment system for positioning a rolling element relative to a first cylinder having a first outer diameter and relative to at least a second cylinder adapted to replace the first cylinder and having a second outer diameter different than the first outer diameter, the adjustment system comprising an actuating member operable to displace the rolling element relative to the first cylinder, the actuating member having first and second ends, the first end being pivotally connected to a frame of the printing press and the second end being mechanically linked to the rolling element, the actuating member providing sufficient displacement to bring the rolling element into contact with the first cylinder such that a predetermined contact pressure therebetween is reached, the actuating member also being operable to bring the rolling element into contact with the second cylinder such that the predetermined contact pressure therebetween is reached.

Also in accordance with the present invention, there is provided a method for displacing a rolling element relative to at least a cylinder in a printing press, the rolling element being mechanically linked to an adjustment system composed of first and second independently controllable adjustment mechanisms, the method comprising the steps of setting the first adjustment mechanism to a predetermined length so that a total length of the adjustment system is such that the rolling element is out of contact with the cylinder, and extending the second adjustment mechanism such as to bring the rolling element in contact with the cylinder until a desired contact pressure therebetween is reached.

Further in accordance with the present invention, there is provided an offset printing press including at least a first cylinder and a rolling element mounted in a frame structure in serial contactable engagement, the printing press comprising an adjustment mechanism operable to displace the rolling element between a predetermined printing position, wherein the rolling element and the first cylinder are in contacting engagement, and a disengaged position, wherein the rolling element is removed from contacting engagement with the first cylinder, the adjustment mechanism being selectively actuable and providing controlled variable displacement of the rolling element relative to the first cylinder.

BRIEF DESCRIPTION OF THE DRAWINGS

Having thus generally described the nature of the invention, reference will now be made to the accompanying drawings, showing by way of illustration a preferred embodiment thereof and in which.

DETAILED DESCRIPTION OF THE PREFERRED EMBODIMENT

Figure 1:
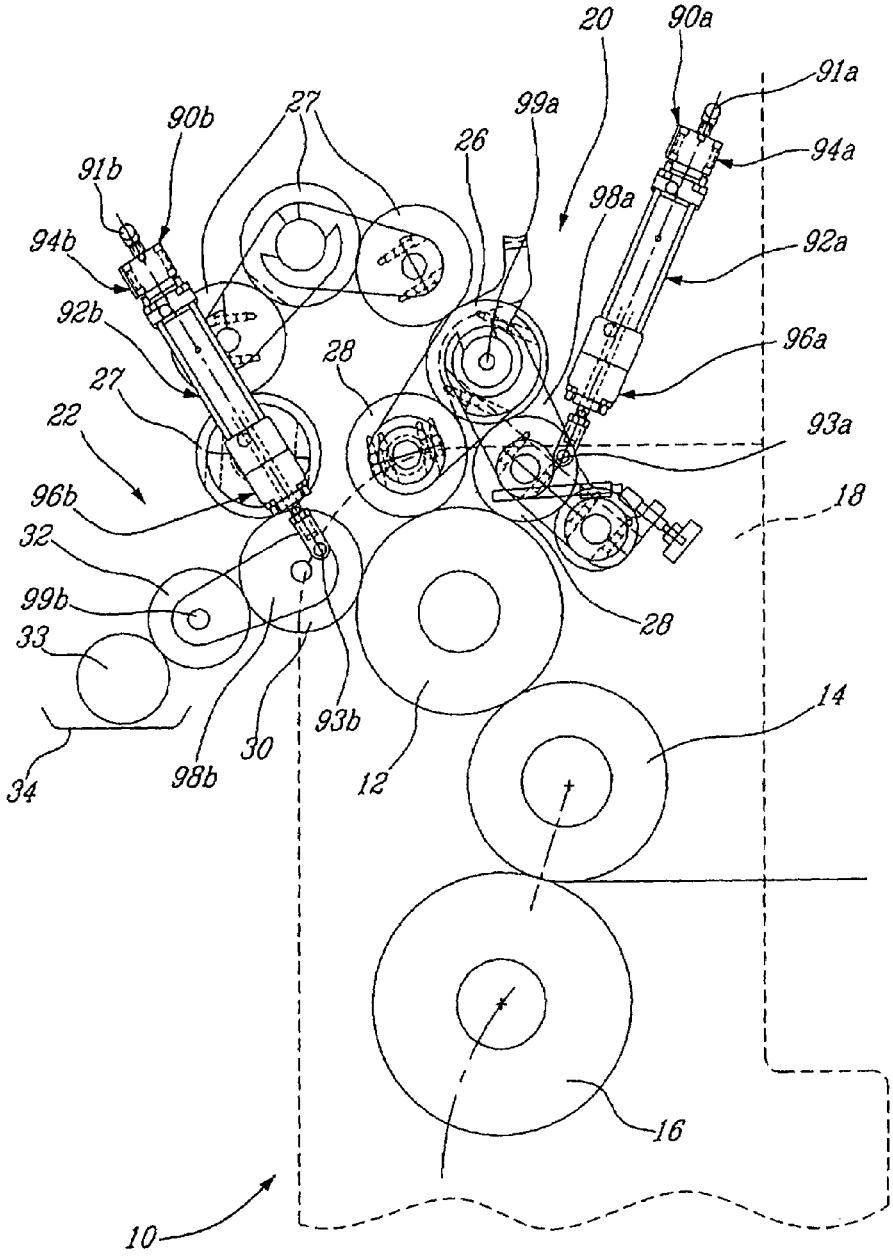
FIG. 1 is a schematic side elevation view of an offset printing press including form rollers adjustment systems according to a preferred embodiment of the present invention.

Referring to FIG. 1, an offset printing press 10 generally comprises a plate cylinder 12, a blanket cylinder 14 and an impression cylinder 16, all supported within a common frame structure 18. At least the plate and blanket cylinders 12,14 are adapted to be completely removed from the printing press 10, such that corresponding replacement cylinders having a different diameter can be re-engaged in the press in their place. Water and ink are supplied to the plate cylinder 12 by the dampening unit 22 and the inking unit 20 respectively.

The inking unit 20 generally comprises at least one ink transfer roller 26 receiving ink from an ink supply. The inking unit also comprises ink form rollers 28 in direct contacting engagement with the transfer roller 26 receiving the ink, and in direct contacting engagement with the plate cylinder 12 to transmit the ink thereto. The dampening unit 22 generally comprises a dampening form roller 30 in direct contacting engagement with the plate cylinder 12 and with dampening fluid transfer rollers 32,33, which transfer the dampening fluid from the dampening supply 34 to the dampening form roller 30. A series of transmission rollers 27 can also transfer ink from the ink supply to the dampening form roller 30, so that the dampening form roller 30 applies both water and ink to the plate cylinder 12.

The plate cylinder 12 generally comprises a circumferentially disposed printing plate on the outer surface thereof, the circumference of the plate cylinder corresponding to the length of the print repeat produced by the printing plate. The water and ink fed to the plate cylinder 12 are transferred from the exterior surface thereof to the blanket cylinder 14, which is in contacting engagement with the plate cylinder 12. Either sheets or a continuous web are fed between the blanket cylinder 14 and an impression cylinder 16, which is similarly in contacting engagement with the blanket cylinder 14. All cylinder rollers are rotatable and in precise contacting engagement with each adjacent roller along a contact stripe, such that fluid is transferred from one roller to the next. This contact stripe is precisely set, to ensure exact and uniform contact pressure along the entire length of the rollers.

The present invention concerns an adjustment mechanism for rolling elements of the printing press. The term rolling element as used herein is defined to comprise any substantially cylindrical and rotatable press element, including both rollers, such as ink or dampening form rollers, and cylinders, such as plate, blanket or impression cylinders.

In a preferred embodiment, illustrated in FIG. 1, the adjustment system 90*a,b* is adapted to be used with form rollers 28,30. Although a single adjustment system 90*a* is shown for the ink form roller 28 and a single adjustment system 90*b* is shown for the dampening form roller 30, two separate adjustment systems 90*a,b* are preferably used for each, one disposed at each end thereof. The adjustment systems 90*a,b* used with the inking and dampening units 20,22 being similar in geometry and function, they will be described simultaneously herein. However, it is to be understood that the adjustment system 90*a* for the inking form roller 28 and the adjustment system 90*b* for the dampening form roller 30 are independently operable from one another.

Each adjustment system 90*a,b* generally comprises an integrated multiple pneumatic actuator assembly having a first pneumatic actuator 92*a,b* and a second pneumatic actuator 94*a,b*. The first pneumatic actuator 92*a,b* includes an integral locking mechanism 96*a,b*. The adjustment system 90*a,b* also comprises a fixed end 91*a,b* which is pivotally engaged to the press frame structure 18, and an opposed translating free end 93*a,b* which is pivotally engaged to a support or link member 98*a,b*. The link member 98*a,b* rotationally supports the form roller 28,30 and rotates about a fixed pivot 99*a,b* which is preferably located at the central axis of the transfer roller 26,32.

The adjustment system 90*a,b* permits the form roller 28,30 to be "thrown on" or "thrown off", such that the form roller 28,30 can be selectively engaged or disengaged from contact with the plate cylinder 12. The adjustment system 90*a,b* also allows for the location of the form roller 28,30 to be variable while remaining in contact with the transfer roller 26,32, which permits the form roller 28,30 to accommodate displacement of the plate cylinder 12 or an alternate plate cylinder having a different diameter. The adjustment system 90*a,b* also permits fine contact stripe adjustment between the form roller 28,30 and the plate cylinder 12.

In operation, the form roller 28,30 is correctly positioned in contact with the plate cylinder 12 according to the following. With the second pneumatic actuator 94*a,b* fully extended to the end of its stroke, the first pneumatic actuator 92*a,b* is extended by air pressure and is precisely adjusted until a desired contact stripe is achieved between the form roller 28,30 and the plate cylinder 12. The air pressure in the first pneumatic actuator 92*a,b* of each form roller adjustment system 90*a,b* is preferably set by an independent air regulator. The air regulators can be programmed to different fixed values, corresponding to different plate cylinder diameters, so that only a fine adjustment may be required by the operator to obtain a desired contact stripe. Once the desired contact stripe is obtained, the air-actuated locking mechanism 96*a,b* is engaged to lock the output rod of the first pneumatic actuator 92*a,b* in position, thereby fixing the distance between the translating free end 93*a,b* and the fixed end 91*a,b* of the form roller adjustment system 90*a,b*. Accordingly, the air pressure which regulates the first pneumatic actuator 92*a,b* can be statically adjusted (ie: when the press is not running) such that a desired contact stripe width between the form roller 28,30 and the plate cylinder 12 is achieved, and the brake or locking mechanism 96*a,b* is then locked to fix the first pneumatic actuator in position. Thus, during operation of the press, the locking mechanism 96*a,b* provides a mechanical stop which correctly positions the form roller in contacting engagement with the plate cylinder such that a desired contact pressure therebetween is achieved.

The form roller 28,30 is disengaged from the plate cylinder 12 according to the following. With the first pneumatic actuator 92*a,b* locked by the locking mechanism 96, the second pneumatic actuator 94*a,b* is actuated to retract, thereby shortening the overall length of the form roller adjustment system 90*a,b*. This causes the link member 98*a,b* to rotate about the transfer roller 26,32, lifting the form roller 28,30 out of contacting engagement with the plate cylinder 12. Since the contact stripe before the disengagement of the form roller 28,30 from the plate cylinder 12 was determined with the second pneumatic actuator 94*a,b* fully extended, and since the first pneumatic actuator 92*a,b* is locked during that disengagement, a simple return to full extension of the second pneumatic actuator 94*a,b* will place the form roller 28,30 back in contact with the plate cylinder 12 with the same contact stripe.

The form roller adjustment system 90*a,b* alternately includes an integral locking mechanism in the second pneumatic actuator, so that the desired contact stripe can be set by the first pneumatic actuator with the second pneumatic actuator being locked at a chosen length. Retraction of the second pneumatic actuator from the chosen length thus breaks contact between the form roller and the cylinder, and extension of the second pneumatic actuator back to the chosen length returns the set contact stripe between the two rollers. In this case, the second pneumatic actuator is adapted to retain a memory of the chosen length to be able to automatically return thereto after retraction.

Figure 2:
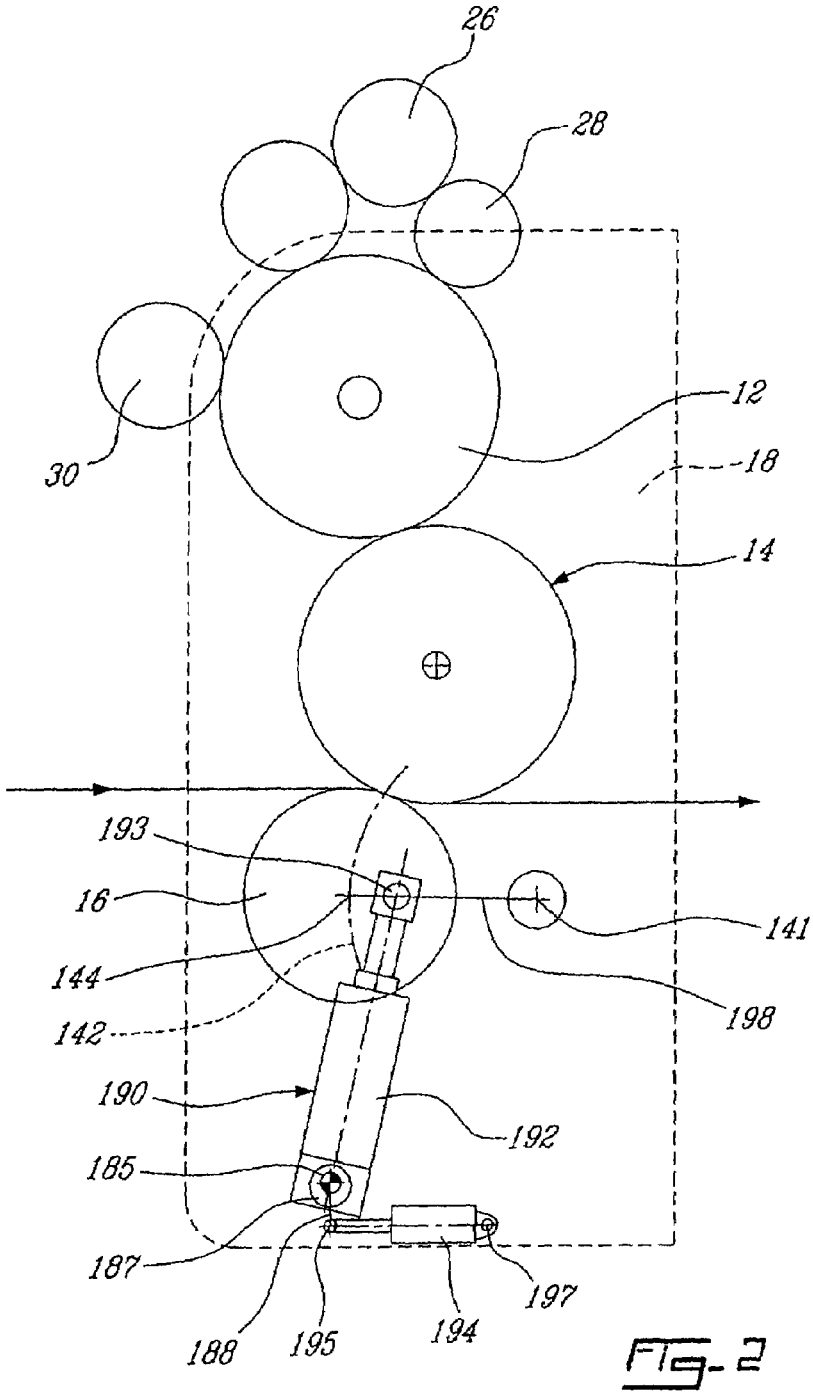
FIG. 2 is a schematic side elevation view of an offset printing press including a cylinder adjustment system according to an alternative embodiment of the present invention.

Referring to FIG. 2, an alternative embodiment of the adjustment system 190 of the present invention is illustrated, adapted to be used to adjust the position of the impression cylinder 16 with respect to blanket cylinders 14 of various sizes, as well as to "throw-on" or "throw-off" the impression cylinder 16 with respect to the blanket cylinder 14 when the printing process is to be stopped. This permits printing to be interrupted, without having to drastically displace the impression cylinder and blanket cylinder relative to one another, and permits printing to be easily re-started without having to precisely reset the contact stripe between these cylinders.

The impression cylinder 16 rotates about its center 144 which is displaceable along an adjustment arc 142 by the action of first link members 198 which rotate about a pivot 141. The impression cylinder adjustment system 190 comprises a first pneumatic actuator 192 having a first translating end 193 which is pivotably engaged to the impression cylinder first link member 198. A second, opposed end 185 of the first actuator 192 is pivotably engaged to an eccentric mounting assembly 187 which is rotatable within the frame structure 18 of the printing press 10. The eccentric rotating assembly 187 of the first actuator 192 is rotatable by a second actuator 194, which is preferably a smaller pneumatic cylinder. A first translating end 195 of the second actuator 194 is engaged to the eccentric rotating assembly 187 by a second link member 188. Opposed ends of the second link member 188 are respectively pivotably connected with the translating end 195 of the second actuator 194 and the second end 185 of the first actuator which is eccentrically engaged to the rotating assembly 187. A second end 197 of the second actuator 194 is not displaceable, but is pivotably connected to the frame structure 18.

Accordingly, and similarly to the first embodiment of the adjustment system 90*a,b* previously described, the first actuator 192 is used for impression adjustment, such that the impression cylinder can be displaced to accommodate the particular size of blanket and plate cylinders being employed, and to control the contact pressure between the impression cylinder 16 and the blanket cylinder 14. By extending or retracting the first translating end 193 of the first actuator 192, the impression cylinder first link member 198 is thus pivoted such that the impression cylinder 16 displaced as required. The first actuator 192 preferably has a relatively large travel, such that plate and blanket cylinder of various sizes can be accommodated. However, the first actuator is also preferably precisely controlled, such that a desired contact pressure between the impression cylinder 16 and the blanket cylinder 14 can be set. Once this is set, the first actuator 192 is locked, such that the relative positions of the first and second ends thereof are fixed.

The second actuator 194 of the impression cylinder adjustment system 190 is used to "throw-on" or "throw-off" the impression cylinder 16, such that printing can be started or stopped when required. Displacing the translating end 195 of the second actuator 194 acts to rotate the eccentric rotating assembly 187 within the frame structure 18, thereby slightly displacing the second end 185 of the locked first actuator 192 by a slight distance, which accordingly disengages the impression cylinder 16 from contact with the blanket cylinder 14 by said slight distance. This slight distance generally corresponds to the eccentricity of the second end 185 of the first actuator 192 relative to the center of rotation of the rotating assembly 187. Thus, the precise location of the impression cylinder and the contact stripe relative to the blanket cylinder can be preset by the first actuator 192 and then locked in position, and the second actuator 194 can be activated to easily engage and disengaged the impression cylinder 16 with the blanket cylinder 14, without having to reset the position and contact stripe each time. A dial-adjusted mechanical stop for the piston of the second actuator 194 is preferably also provided, such that slight displacement of the impression cylinder 16 relative to the blanket cylinder 14 is possible to allow for the particular thickness of the web or sheet substrate passing therebetween.

Accordingly, the pneumatically actuated and controlled roller and cylinder adjustment system 90*a,b* and 190 permits the elimination of mechanical stoppers, which have typically been used in the past to locate the form rollers relative to the plate cylinder and the impression cylinder relative to the blanket cylinder. The form roller and cylinder adjustment systems 90*a,b* and 190 provide the ability to throw on or off the form rollers 28,30 and the impression cylinder 16, and further permits more accurate adjustment of the contact stripe. It also enables the positioning of the form rollers 28,30 and impression cylinder 16 as required regardless of the plate and blanket cylinder size used.

Although pneumatic actuators were described as being the preferred kind of actuator for the adjustment systems 90*a,b* and 190, it is understood that other appropriate kinds of actuating members may be used, such as hydraulic or electric linear actuators for example. Particularly, in one alternate embodiment of the present invention, the first pneumatic actuator 192 is alternately a ball screw actuator. If hydraulic actuators are used, hydraulic fluid pressure would have to be adjusted to obtain the desired contact stripes.

Also, the adjustment systems as described herein can be used to similarly adjust other rolling elements in the printing press as required.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

What is claimed is:

1. In a printing press, an adjustment system for positioning a rolling element relative to a first cylinder having a first outer diameter and relative to at least a second cylinder adapted to replace the first cylinder and having a second outer diameter different than the first outer diameter, the adjustment system comprising:

an actuating member operable to displace the rolling element relative to the first cylinder, the actuating member having first and second ends, the first end being pivotally connected to a frame of the printing press and the second end being mechanically linked to the rolling element, the actuating member providing sufficient displacement to bring the rolling element into contact with the first cylinder such that a predetermined contact pressure therebetween is reached;

the actuating member also being operable to bring the rolling element into contact with the second cylinder such that the predetermined contact pressure therebetween is reached; and wherein the actuating member includes first and second independently controllable adjustment mechanisms, the first adjustment mechanism providing the sufficient displacement to bring the rolling element into contact with one of the first and second cylinders, while the second adjustment mechanism maintains a part of the actuating member at a predetermined length such that the predetermined contact pressure is reached, the second adjustment mechanism being operable to retract the part of the actuating membet from the predetermined length such as to temporarily disengage the rolling element from the one of the first and second cylinders, the second adjustment mechanism being operable to return the part of the actuating member to the predetermined length to re-engage the rolling element with the one of the first and second cylinders, thereby re-establishing the predetermined contact pressure therebetween without operating the first adjustment mechanism.

2. The adjustment system according to claim 1, wherein the rolling element is a form roller and the first and second cylinders are plate cylinders, the form roller being adapted to distribute at least one of ink and dampening fluid to the first and second plate cylinders.

3. The adjustment system according to claim 1, wherein the rolling element is an impression cylinder and the first and second cylinders are blanket cylinders.

4. The adjustment system according to claim 1, wherein the actuating member is mechanically linked to the rolling element through a link member connected to the second end, the link member rotatably retaining the first roller and being pivotable about a fixed pivot.

5. The adjustment system according to claim 4, wherein the rolling element is a form roller and the fixed pivot is located at a central axis of a transfer roller in continuous contact with the form roller.

6. The adjustment system according to claim 1, wherein the first and second adjustment mechanisms respectively include first and second actuators.

7. The adjustment system according to claim 6, wherein the first and second actuators are fluid driven.

8. The adjustment system according to claim 1, further comprising locking means to lock the first adjustment mechanism after the desired contact pressure is reached.

9. The adjusrment system according to claim 1, wherein the predetermined length is the maximal length of the second adjustment mechanism.

10. The adjustment system according to claim 1, further comprising locking means to lock the second adjustment mechanism at the predetermined length.

11. An offset printing press including at least a first cylinder and a rolling element mounted in a frame structure in serial contactable engagement, the printing press comprising an adjustment mechanism operable to displace the rolling element between a predetermined printing position, wherein the rolling element and the first cylinder are in contacting engagement, and a disengaged position, wherein the rolling element is removed from contacting engagement with the first cylinder, the adjustment mechanism being selectively actuable and providing controlled variable displacement of the rolling element relative to the first cylinder, the adjustment mechanism including a first actuator having a first end engaged with the rolling element and a second end engaged to a mounting assembly connected to the frame structure, wherein the first actuator is operable to displace the rolling element relative to at least a second cylinder in the offset printing press and to control a contact pressure therebetween, the first actuator being selectively securable in a given position such that the distance between the first and second ends thereof remains fixed, the adjustment mechanism further including a second actuator having a first end engaged to the mounting assembly and a second end engaged to the frame structure, the second actuator being operable to displace the mounting assembly between a first position, in which the rolling element is in the predetermined printing position, and a second position, wherein the rolling element is in the disengaged position, whereby the second actuator is operable to selectively interrupt and restart printing without having to readjust the contact pressure.

12. The offset printing press as defined in claim 11, wherein the rolling element is an impression cylinder and the first cylinder is a blanket cylinder.

13. The offset printing press as defined in claim 11, wherein the rolling element is a form roller and the first cylinder is a plate cylinder, the form roller being adapted to distribute at least one of ink and dampening fluid to the plate cylinder.

14. The cylinder adjustment mechanism as defined in claim 11, wherein the impression cylinder is rotatably supported on at least one link member having a pivot axis radially spaced from a center of rotation of the cylinder, the first actuator being pivotably engaged to the at least one link member.

15. An offset printing press including at least a first cylinder and a rolling element mounted in a frame structure in serial contactable engagement, the printing press comprising an adjustment mechanism operable to displace the rolling element between a predetermined printing position, wherein the rolling element and the first cylinder are in contacting engagement, and a disengaged position, wherein the rolling element is removed from contacting engagement with the first cylinder, the adjustment mechanism being selectively actuable and providing controlled variable displacement of the rolling element relative to the first cylinder, wherein the rolling element is a form roller and the first cylinder is a plate cylinder, the form roller being adapted to distribute at least one of ink and dampening fluid to the plate cylinder, and wherein the adjustment mechanism includes a first actuator having a first end engaged with the form roller and a second end engaged to a first end of a second actuator, the second actuator having a second end engaged to the frame structure, wherein the first actuator is operable to displace the form roller relative to at least a second cylinder in the offset printing press and to control a contact pressure therebetween, the first actuator being selectively securable in a given position such that the distance between the first and second ends thereof remains fixed, and wherein the second actuator is operable to displace the mounting assembly between a first position, in which the form roller is in the predetermined printing position, and a second position, wherein the form roller is in the disengaged position, such as to selectively interrupt and restart printing without having to readjust the contact pressure.

* * * * *